US007647661B2

(12) United States Patent
Bär

(10) Patent No.: US 7,647,661 B2
(45) Date of Patent: Jan. 19, 2010

(54) WATERBED

(76) Inventor: Stephan Wolfgang Bär, Bachstrasse 59, Dueren (DE) 52335

( * ) Notice: Subject to any disclaimer, the term of this patent is extended or adjusted under 35 U.S.C. 154(b) by 0 days.

(21) Appl. No.: 12/085,503

(22) PCT Filed: Nov. 21, 2006

(86) PCT No.: PCT/DE2006/002051

§ 371 (c)(1),
(2), (4) Date: May 22, 2008

(87) PCT Pub. No.: WO2007/059745

PCT Pub. Date: May 31, 2007

(65) Prior Publication Data

US 2009/0077752 A1 Mar. 26, 2009

(30) Foreign Application Priority Data

Nov. 22, 2005 (WO) ..... PCT/DE2005/002088

(51) Int. Cl.
*A47C 27/08* (2006.01)

(52) U.S. Cl. ..... 5/680; 5/686

(58) Field of Classification Search ..... 5/678, 5/680, 681, 685, 686, 665
See application file for complete search history.

(56) References Cited

U.S. PATENT DOCUMENTS 3,689,949 A * 9/1972 Weinstein et al. ..... 5/680
4,057,862 A 11/1977 LaBianco
4,064,579 A 12/1977 Winther
4,167,049 A 9/1979 Fogel
4,793,013 A * 12/1988 Barbulla ..... 5/686
5,228,157 A 7/1993 Johenning et al.

FOREIGN PATENT DOCUMENTS

DE 101 46 686 4/2003
EP 0 240 479 10/1987
FR 2 669 522 5/1992

OTHER PUBLICATIONS

Search Report dated Apr. 17, 2007 issued for the underlying International PCT Application No. PCT/DE 2006/002051.

* cited by examiner

*Primary Examiner*—Alexander Grosz
(74) *Attorney, Agent, or Firm*—Cohen Pontani Lieberman & Pavane LLP

(57) ABSTRACT

The invention pertains to a waterbed with at least one water-filled mattress, which forms a substantially flat bed surface when in an unloaded state and which is held inside a frame consisting of beams of foamed plastics. On the inside of the waterbed, at least one beam is convexly curved, proceeding upward in an arc from a carrier plate and continuing as a flat surface at the top, underneath the surface of the bed. The mattress, on the side facing the beam, has a concave recess conforming to the arc of the beam and has an extension of rectangular cross section, which covers the top surface of the beam, the extension preferably extending all the way to, and being flush with, the top outside edge of the beam.

22 Claims, 7 Drawing Sheets

WATERBED

CROSS-REFERENCE TO RELATED APPLICATIONS

This is a U.S. national stage of International Patent Application No. PCT/DE2006/002051, filed on Nov. 21, 2006, claiming priority to International Patent Application No. PCT/DE2005/002088, filed Nov. 22, 2005.

BACKGROUND OF THE INVENTION

1.Field of the Invention

The invention pertains to a waterbed with at least one water-filled mattress, which forms a substantially flat bed surface when in the unloaded state and which is held inside a frame consisting of beams of foamed plastic.

2.Description of the Related Art

Many different designs of waterbeds which have proven to be reliable are known. So-called "soft-side" waterbeds have an upper structure consisting of a dimensionally stable tub, in which one or two separate water-filled mattresses are arranged. A waterbed of this type known from EP 0 240 479 has a mattress which has a shape corresponding to that of the tub-like recess and which is introduced into the one-piece mattress carrier. The recess is concavely curved both in the longitudinal direction and in the transverse direction and is adapted to the outlines of a person lying on the bed in such a way that the concave longitudinal curvature is less pronounced under the leg and foot end and more pronounced under head end. As a result, less water is required to fill the mattress, and thus the weight of the mattress is also reduced. On the mattress, furthermore, a top cover is provided, and immediately below that, lying on the mattress, there is a weight-distribution liner. The top cover, the weight-distribution liner, the mattress, and the mattress carrier are held together by an enveloping sleeve, by means of which the water is also held in the mattress under pressure. When the mattress is now subjected to the additional weight of a person and when, as a result of this load, the top cover and the weight-distribution liner are pushed into the mattress, the water is displaced toward the sides, and a bead is formed along the edges, above the edge of the mattress carrier. This edge area is thus no longer available as a bed surface, because a person lying on the bed will almost always position himself/herself as close to the center as possible because of the shape of the surface caused by the load.

Alternatively, a water-filled mattress can be held by a frame, which usually consists of four individual beams of foamed plastic, which are connected by screws, adhesive, or other types of fastenings to a carrier plate located underneath. The height of the beams is usually the same as the height of the mattress. The beams can be cut to a wide variety of profiles; they can be square or rectangular, for example, as shown in FIG. 1. Alternatively, it is known that these types of square or rectangular beams can be subdivided horizontally and/or vertically as well, as explained, for example, in U.S. Pat. No. 5,228,157, or horizontally according to FIG. 2 as described in DE 101 46 686. By dividing the beam in this way, it is possible to make optimum use of the physical properties of different foamed plastics.

In addition to square or rectangular beams, one-part or multi-part beams which have a bevel on the inside surface are also known. The width of the beam at the top, in cross section, is therefore smaller than that at the bottom, where the beam rests on a carrier plate. There are many different profiles of this type, such as those described in EP 0 240 479, U.S. Pat. Nos. 5,228,157, 4,057,862, and FR 2 669 522, and as illustrated here in FIGS. 3 and 4.

The wedge-shaped beams of foamed plastic which come to a sharp angle at the top where they extend around the mattress have not proven to be acceptable. Although the available bed surface is not reduced around the edges by a frame, a frame of this type lacks sufficient mechanical strength. Under load, e.g., when a person sits on the waterbed, the sharply angled edges of the frame regularly break off.

Because the beams are much stronger and harder than the mattress, a frame of foam beams enclosing the mattress or mattresses thus has the effect of making the available bed surface smaller than the total floor space actually occupied by the waterbed (see FIG. 5). Normally, a "soft-side" waterbed with overall dimensions of 180 cm×200 cm has, on average, a bed surface measuring only about 166 cm×186 cm.

SUMMARY OF THE INVENTION

Against this technical background, the task of the invention is to provide a waterbed in which the bed surface area is not reduced by a frame, whereas at the same time the self-supporting properties of a soft-sided waterbed in particular remain preserved, so that there is no need for an additional solid frame of wood, metal, or the like.

In the case of a waterbed with at least one water-filled mattress which, in the unloaded state, offers a substantially flat bed surface and which is held inside a frame consisting of beams of foamed plastic, this technical problem is solved by the measures that, on the inside of the waterbed, at least one beam is convexly curved, proceeding upward in an arc from a carrier plate and continuing as a flat surface at the top, underneath the surface of the bed, and in that the mattress, on the side facing the beam, has a concave recess conforming to the arc of the beam and an extension of rectangular cross section, which covers the top surface of the beam, the extension preferably extending all the way to, and being flush with, the top outside edge of the beam.

As a result of this measure, a certain water-filled height of the mattress lies above the beam of the frame, this filled height being substantially constant over the top surface of the beam, so that it possible for a sleeper to use the entire surface of the mattress as a bed surface, which preferably corresponds to the maximum floor space required for the bed.

Another advantage of this embodiment is to be seen in the fact that the mattress can give way toward the center of the bed as soon as a person lies on the bed. At the same time, the mattress slides back into its original position as soon as the person leaves the bed.

The amount of water required to fill the mattress, furthermore, is considerably reduced by the recesses even though the bed surface is larger. About 250 L are saved in comparison with conventional amounts, which means that the weight of the bed is considerably reduced.

It is possible for a beam to have a one-piece design with a cross section which remains uniform throughout and for the beam to consist of almost completely homogeneous foamed plastic. In particular, these types of standard variants can be provided at the head and/or foot end of the inventive waterbed. Along the long sides of the waterbed, two-part beams are preferred, especially those explained above, which are divided horizontally and thus form two layers, one on top of the other. If a diagonal division of a beam, thus forming two wedges, is provided, preferably four similar beams, mitered at the corners, are assembled to form the frame. In these types of variants, the lower wedge of the beam can be permanently connected to a carrier plate and have a separate covering of suitable material such as upholstery material, leather, or the like. These measures make it possible for the lower wedges, which rest on the carrier plate, and the carrier plate itself to be covered easily by a jacket.

In particular, a beam can have an upper layer or wedge of foamed plastic which becomes flexible when heated to form the top surface and a lower, mechanically strong layer or wedge of foamed plastic to form the bottom. In the case of a horizontal separation, it is preferable for approximately the bottom two-thirds of the beam to consist of a strong foam of suitable density and suitable crush strength, preferably a cold foam. The upper one-third of the beam can then be formed of a flexible, especially viscoelastic foam, which becomes soft when the mattress is heated. Even when lying on the outer edge of the mattress, a sleeper will not sense the beam located underneath.

In addition to a horizontal division of the beam, it is also possible according to another design variant for the bottom layer to have a diagonal division, extending, on the side facing the inside of the bed, from the bottom up toward the outside of the bed, thus forming a lower wedge, which closes off the outside surface of the bed, and a upper wedge, which at least contributes to the formation of the convex arc section on the inside of the bed. Thus the bottom layer of the beam can also consist of two different foamed plastics. In particular, however, a bottom part of the mattress can have its own separate jacket, and the lower wedge can have its own separate covering, for which reason, in the case of beams of this type, it preferable that four beams of similar design, mitered at the corners, be used to form the frame.

In a waterbed according to the invention, furthermore, the beams can be provided on the outside of the bed with externally attached edge strips of foamed plastic, which project beyond the top of the beam and extend as far as the bed surface. These edge strips represent lateral stops which prevent the mattress from migrating sideways beyond the edge of the beam and beyond the pad on the top surface.

It is also possible for the beams and the edge strips to be flush with each other in a common, lower plane, and in particular for the beams and the strips both to rest on a carrier plate. The edge strips, furthermore, give the beams a clean outside surface. It is also possible in particular for the beams and the edge strips of foamed plastic to be permanently connected to each other, especially by means of an adhesive. The foam body thus obtained can then be covered in its entirety with a suitable material such as nonwoven or felt material. This foam body can be assembled out of a wide variety of different layers.

Alternatively, the bottom layer of a beam can project beyond the top layer on the outside of the bed, or the lower wedge can project—again on the outside of the bed—beyond the upper wedge of the bottom layer and also beyond the top layer by an amount equal to the thickness of an edge strip. These projections thus form shoulders, on which the edge strip can rest. This is especially advantageous when the bottom layer of the beam is divided diagonally and a jacket for the bottom mattress part is introduced into the parting plane between the beams. The jacket can then be pulled further up along the outside surface of the edge strip.

If an edge strip is provided around the edges of the bed to enclose the mattress and at least certain sections of the beam, then this edge strip should be flexible, and in particular it should also be made of foamed plastic, so that it has at least a certain resilience. It will therefore not give way in a disturbing manner when someone sits on the edge of the bed but will continue to hold the mattress.

To reinforce this effect, the edge strip can have an upper section with a flat, horizontal profile of a stabilizing body. This profile rests on round bars spaced a certain distance apart, the bottom ends of the bars being held in guide sleeves, in which the bars can slide vertically up and down. The flat profile distributes vertical loads on the edge strips over a comparatively large area and is supported also on the spaced-apart round bars, the bottom ends of which are held with freedom of vertical movement in guide sleeves. Thus the lateral pressure of the mattress is also safely absorbed. The flat profile is preferably a narrow, flat strip of metal or plastic; the round bars are preferably of round steel; and the guide sleeves preferably consist of steel tubes.

According to a design variant, a second flat profile with openings through which the round bars pass can be provided underneath the stabilizing body in the upper section. Under vertical load, this second flat profile therefore works almost completely independently of the first. Forces are transmitted only via the elastic foamed plastic located between the flat profiles.

It is also possible for the edge strip to be closed off underneath by another flat profile, which also forms the base plate on which the guide sleeves rest.

In a further elaboration of the waterbed according to the invention, a common covering can be provided for a beam or a top layer and an upper wedge of a lower layer as well as for the associated the edge strip, where a slat, which can be screwed to a common carrier plate on the inside of the bed, is also covered by this common covering. The beam, the edge strip, and the slat or the top layer and the upper wedge of a bottom layer of a beam, jointly with the slat resting on them, are joined by the use of, for example, an adhesive, to form a unit and held in the common covering. This guarantees the secure positioning and more secure retention of the beam. The slat is advisably made of a strong material such as wood or a plastic such as PVC.

In the waterbed according to the invention, the mattress conforms to the shape of the tub defined by the beams of the frame. Independently of this, either one mattress or two separate mattresses can be provided. If two mattresses are held in the one frame, the sides of the mattresses situated in the center are designed to be perpendicular to a common carrier plate.

In correspondence with the number of mattresses provided, one or two waterbed heaters are usually used, which are installed underneath the mattresses on a common, usually multi-part carrier plate. If two separate mattresses and thus two waterbed heaters, one under each mattress, are provided, a vertical partition wall is usually introduced between the two mattresses. This wall consists of a thermally insulating material and is suitably covered. This prevents the undesirable exchange of heat between the two mattresses.

BRIEF DESCRIPTION OF THE DRAWINGS

The waterbed according to the invention is explained in greater detail on the basis of the drawing, in which exemplary embodiments are illustrated schematically and not to scale.

DETAILED DESCRIPTION OF THE PRESENTLY PREFERRED EMBODIMENTS

Figure 3:
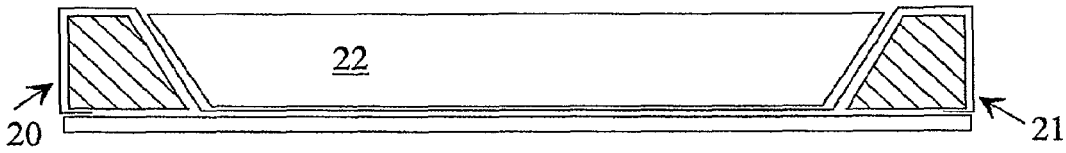
Fig. 3 Prior Art
Figure 4:
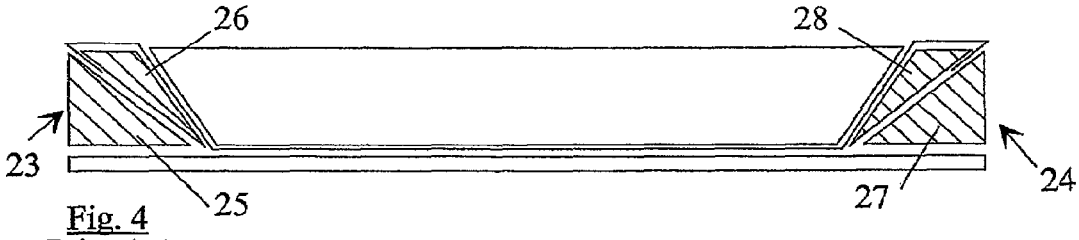
Fig. 4 Prior Art
Figure 5:
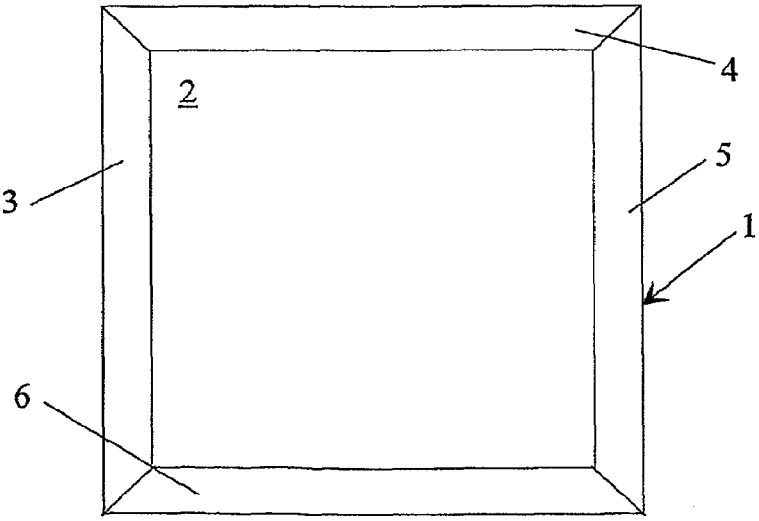
Fig. 5 Prior Art
FIG. 5 shows a top view of a conventional waterbed.

FIGS. 1-4 show simple cross sections of conventional beams of foamed plastic, which form a frame 1 according to FIG. 5. The frame encloses a water-filled mattress 2. The individual beams 3-6 are mitered, so that no butt joints are visible. FIG. 5 also shows the typical problem of these types of frames 1, namely, that a comparatively wide edge, not covered by the waterbed mattress 2, remains, so that the entire actual floor space of the bed is not available as a bed surface.

Figure 1:
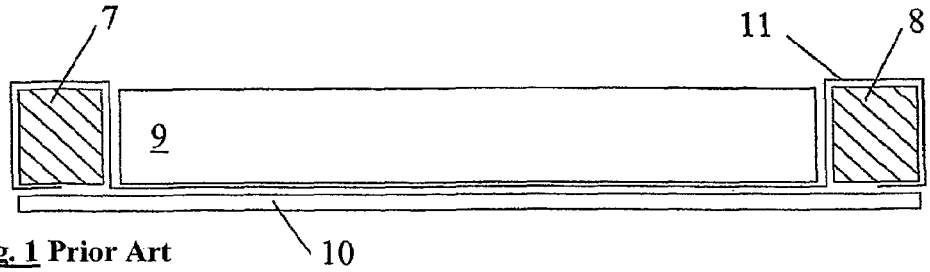
Fig. 1 Prior Art
FIGS. 1-4 show cross sections through conventional beams, which form a frame around a mattress.

Typical known embodiments of these types of beams, as shown in FIG. 1, are square or rectangular cross sections of uniform material throughout; the beams 7, 8 extend around the edges of the mattress 9. The beams 7, 8 and the mattress 9 are normally arranged on a common carrier plate 10, where a safety tub 11 in the form of a sheet, for example, is arranged between the beams 7, 8 and the carrier plate 10 on the one hand and the mattress 9 on the other. If the mattress 9 should develop a leak, the tub will safely contain the escaping liquid.

Figure 2:
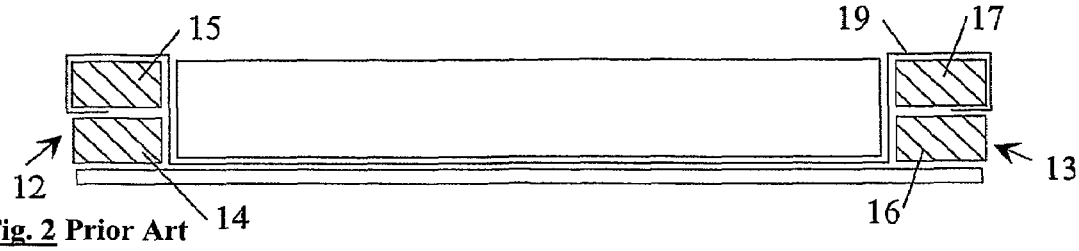
Fig. 2 Prior Art

In the exemplary embodiment according to FIG. 2, the edge beams 12, 13 are also of square cross section throughout. The beams 12, 13 are subdivided horizontally here to form two layers 14, 15 in the one case and the two layers 16, 17 in the other. The ends of the sheet forming the safety tub 19 extend around the top layers 15, 17 and down the outside surface, where they are clamped securely in place between the two individual layers 14, 15; 16, 17. Comparable embodiments of beams 12, 13 are known from DE 101 46 686 and from DE 86 29 051.

The percentage of the floor space of the waterbed available as bed surface can be increased by using beams with wedge-shaped cross sections according to FIGS. 3 and 4. FIG. 3 shows this type of wedge-shaped arrangement according to EP 0 240 479 or U.S. Pat. No. 5,228,157. Because the mattress exerts less pressure at the top than it does at the bottom, the beams 20, 21 can also be narrower at the top.

FIG. 4 shows beams 23, 24, each of which is assembled from two wedges 25, 26; 27, 28. The plane which separates them extends from the inside bottom edge of the waterbed to the outside top edge of the beams 23, 24. Beam cross sections 23, 24 of this type, known from U.S. Pat. No. 4,057,862 or FR 2 669 522, suffer from the disadvantage that, when someone sits on the edge, for example, it is easy for pieces of the lower wedges 25, 27 to break off, especially at the outside top edges of the waterbed.

Nevertheless, in the case of the embodiments of the beams according to FIGS. 3 and 4, there remains the problem that, as shown in FIG. 5, there is still a comparatively wide edge surrounding the mattress 2 which is unavailable as a bed surface.

The waterbed according to the invention as explained on the basis of the following figures also has a frame consisting of beams of foamed plastic, which enclose one or two mattresses.

Figure 6:
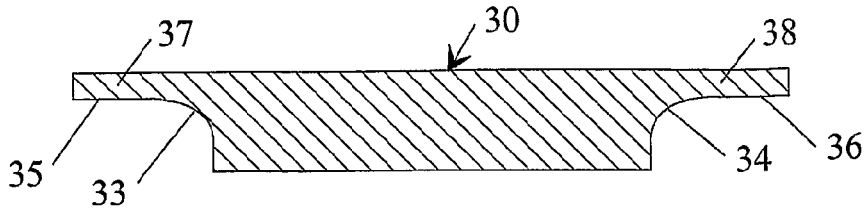
FIG. 6 shows a cross section through an individual mattress according to the invention.

FIG. 6 shows a cross section of a mattress 30 of this type for a waterbed according to the invention. Adapted to the shape of the beam 31, shown in cross section in FIG. 10, the mattress 30 has concave recesses 33, 34 around the edges, conforming to the arc 32 of the beam 31. Each of these recesses merges into a substantially horizontal bottom surface 35, 36 of an extension 37, 38 of the mattress 30 with a rectangular cross section. These extensions 37, 38 completely cover a beam 31 and in particular are flush with its outside surface 39.

Figure 7:
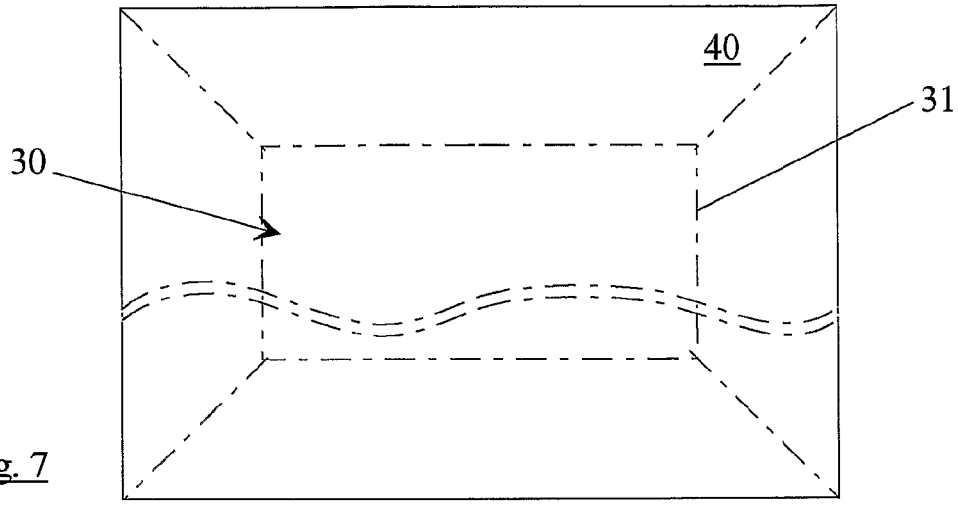
FIG. 7 shows a top view of an inventive waterbed with a mattress.

As a result of this coverage, a view from above onto a waterbed according to the invention as seen in FIG. 7 shows that the entire surface of the waterbed according to the invention is available as a bed surface. The beams 31, which are mitered together and located under the bed surface 40 of the mattress 30, are indicated in dash-dot line.

Figure 8:
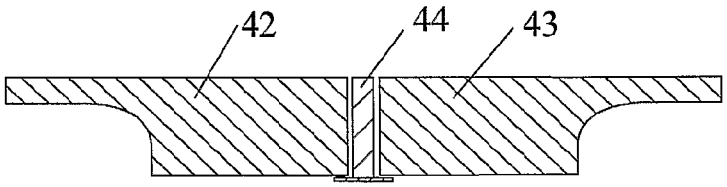
FIG. 8 shows the arrangement of two mattresses for a waterbed according to the invention.

The waterbed according to the invention is independent of whether one mattress 30 or two mattresses 42, 43 according to FIG. 8 are provided. The two mattresses 42, 43 are usually separated from each other by a thermal insulating partition wall 44, usually vertical. For an arrangement of this type with two mattresses 42, 43, two heaters are also usually provided under the mattresses 42, 43 in a corresponding manner.

Figure 9:
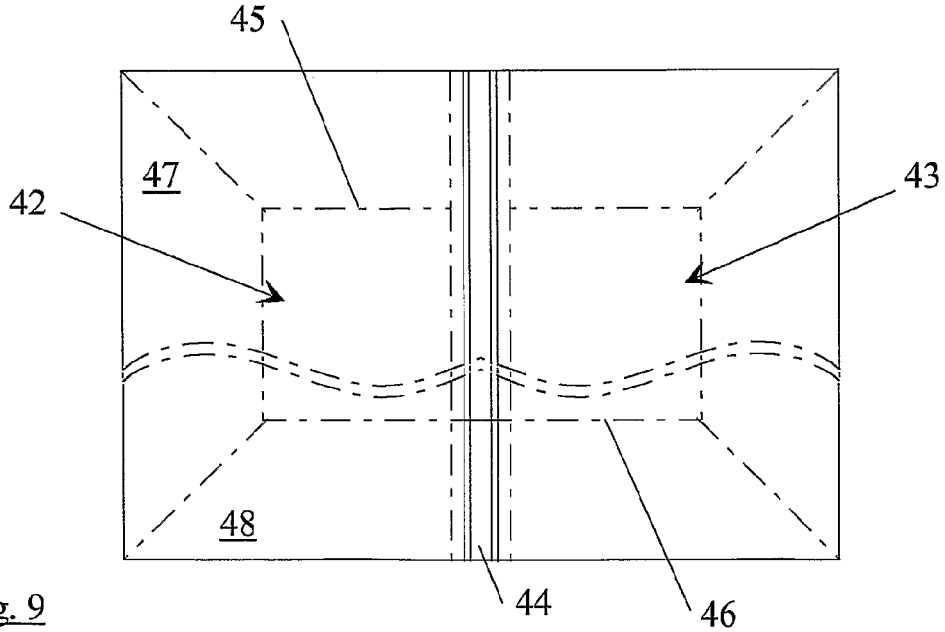
FIG. 9 shows a top view of the same arrangement.

As the top view of this type of arrangement with two mattresses 42, 43 shown in FIG. 9 makes clear, the partition wall 44 can pass through the beams 45, 46 indicated in dash-dot line underneath the bed surface 47, 48 of the mattresses 42, 43.

Alternatively, the partition wall 44 can be designed with a concave recess at the edges so that it conforms to the beams 45, 46, which in this case would be continuous. The partition wall 44 is merely set down onto the beams 45, 46.

Figure 10:
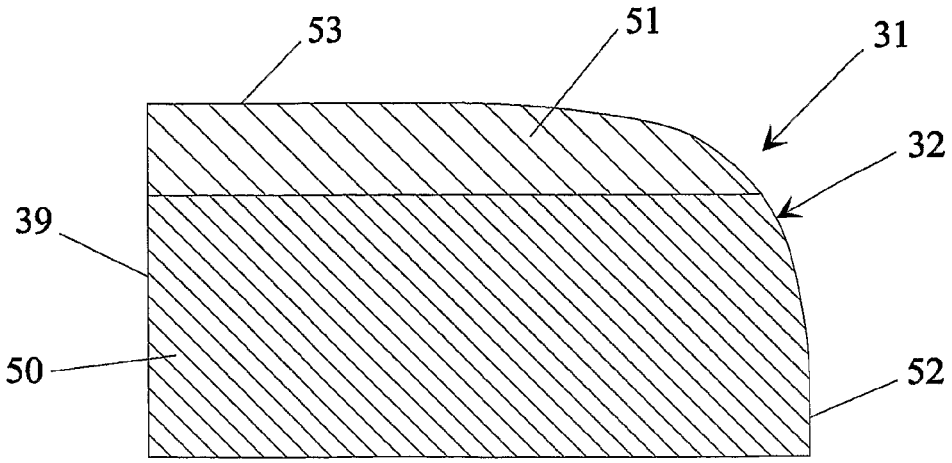
FIG. 10 shows a cross section through a beam of the inventive waterbed.
Figure 11:
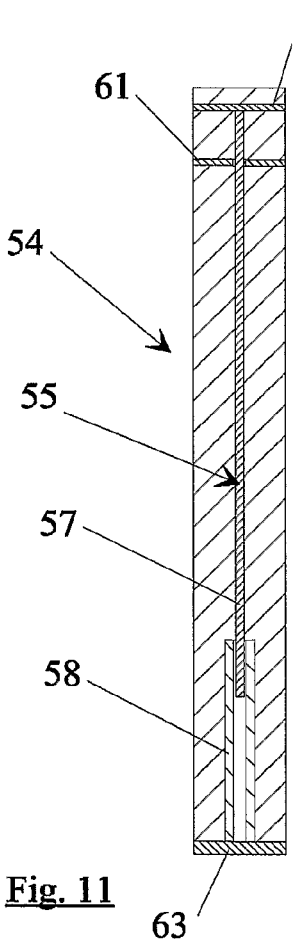
FIG. 11 shows a cross section through an edge strip not under load.

The beam 31 of foamed plastic according to FIG. 10 has two horizontally separated layers 50, 51 of different types of foamed plastic. The bottom layer 50 consists of a strong foam of high strength, which in particular gives one mattress 30 or two mattresses 42, 43 dimensional stability. The top layer 51 of the beam 31 is preferably a viscoelastic foam, which, when heated by the mattress 30 or mattresses 42, 43, becomes flexible, so that a person sitting on the outer edge of a mattress 30 or of the mattresses 42, 43 does not sense the beams underneath.

The beam 31 has a comparatively short section 52 on the inner side of the waterbed, which extends substantially vertically upward from the bottom. This section merges into the convexly curved arc 32. This arc 32 then merges with a substantially horizontal, flat top surface 53, located below the bed surface, on which the extension 37 or 38 of the mattress 30 or the corresponding extensions of the mattresses 42, 43 rest.

In addition to the horizontal subdivision into two layers 50, 51, it is also possible in principle to provide a diagonal division into two wedges as shown in FIG. 4.

An edge strip 54 of foamed plastic can be attached to the surface 39 of a beam 31 on the outside of the waterbed; in particular, this strip can extend all the way around the bed (see FIGS. 11-16). These edge strips 54 cover the surface of the beams 31 on the outside of the bed and also project sufficiently beyond the top surface 53 that they are substantially flush with the bed surface 40 of a mattress 30 or of bed surfaces 47, 48 of mattresses 42, 43 in the unloaded state. Such edge strips 54 stabilize the mattress 30 or mattresses 42, 43 and prevent it or them from migrating beyond the outer sides 39 of the beams 31.

So that the edge strips 54 do not disturb a person sitting on a mattress 30, the edge strips 54 are made of a comparatively flexible foamed plastic, which provides elastic resilience.

Figure 12:
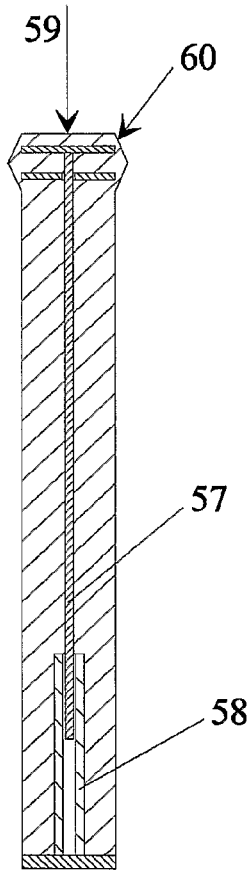
FIG. 12 shows the edge strip of FIG. 11 under vertical load.
Figure 13:
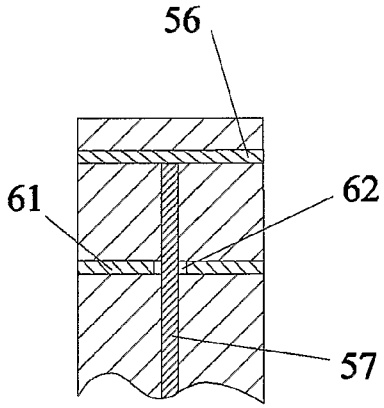
FIG. 13 shows in detail the upper area of an edge strip according to FIG. 11.

In particular, it is possible for the edge strip 54 to have a stabilizing body 55 with a horizontal flat profile 56, arranged in the upper section of the edge strip 54. This flat profile 56 rests on round bars 57, which are spaced a certain distance apart. See also FIG. 14. The bottom ends of the round bars 57 are held in guide sleeves 58 so that they can slide vertically up and down. When a vertical load acts on the edge strip in the direction of the arrow 59, the upper area is deformed and, under the braking action of friction, the edge strip 54 forms a head 60, as shown in FIG. 12. The top section of the strip now appears compressed, and the flat profile 56 has been pushed lower, which has the effect of pushing the round bar 57 more deeply into the guide sleeve 58. As a result of these design measures, the vertical forces according to arrow 59 are distributed more uniformly and effectively in the edge strip 54, and in addition the edge strip 54 is given the necessary stability in the transverse direction, so that the forces transmitted horizontally by the rectangular extensions 37, 38 of a mattress 30 can be absorbed.

Underneath the first strip-like flat profile 56 there is a second, strip-like flat profile 61, which has openings 62, through which the round bars 57 pass. This second, strip-like flat profile substantially limits the deformation of the head 60.

Underneath the edge strip 54, another flat profile 63 can close off the bottom of the edge strip 54.

The strip-like flat profiles are preferably made of metal, so that, if the round bar 57 is, for example, a steel tube, the flat profile 56 resting on that bar can be welded to it. In a corresponding manner, the guide sleeves 58, consisting of metal tubes, can be welded to a flat bottom profile 63 of metal.

The flat profiles 56, 61, and 63 are preferably joined to the foamed plastic of the edge strip 54, however, by the use of an adhesive.

The flat profile 56 is usually located a few millimeters under the top surface of the edge strip 54. The flat profile 61 is introduced only slightly below that.

Figure 14:
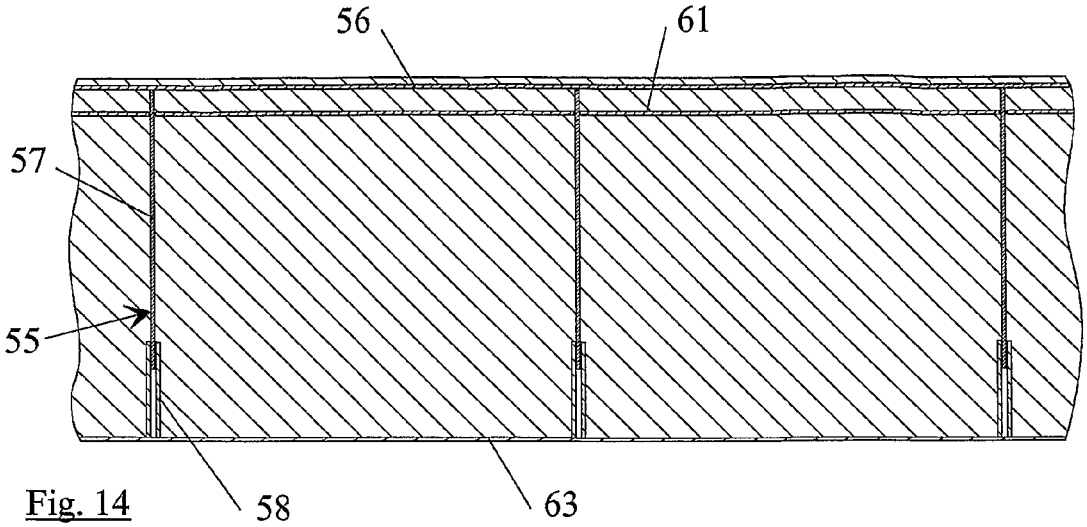
FIG. 14 shows a longitudinal cross section through an edge strip with several stabilizing bodies.

FIG. 14 shows a longitudinal cross section through an edge strip 54 according to FIG. 10 in the unloaded state. Stabilization bodies 55 are arranged at regular intervals. In the upper area, the flat profile 56 extends continuously through the edge strip 54; this profile is supported on the round bars 57 of the stabilization member 55. The round bars 57 pass through the additional flat profile 61 extending likewise over the entire length of the edge strip 54, and in each case their bottom ends are held in the guide sleeves 58 with freedom to slide vertically. The bottoms of the guide sleeves 58 rest on the additional flat profile 63, also extending over the entire length of the edge strip 54, and are permanently connected to it, preferably by welding.

Figure 15:
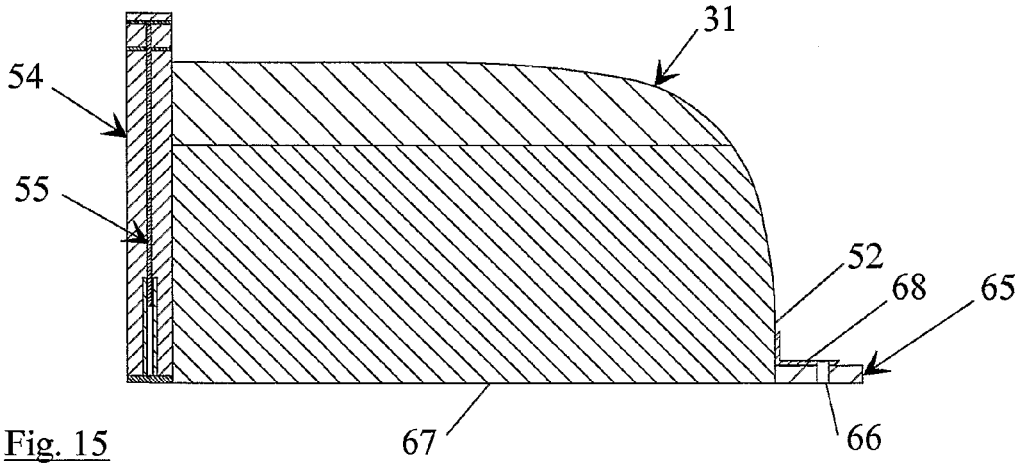
FIG. 15 shows a cross section through a first exemplary embodiment of a beam with an edge strip set in place.

FIG. 15 shows a beam 31, to the outside surface of which an edge strip 54 of this type has been attached. On the vertical section 52 of the beam 31 facing the inside of the bed, a slat 65 has also been attached, preferably with openings 66 to allow it to be screwed to a common carrier plate.

In the case of the exemplary embodiments according to FIGS. 10-15, the beam 31 and the edge strip 54 are flush with each other on a common bottom plane 67. Thus the edge strip 54, the beam 31, and the slat 65 can rest on a common carrier plate, preferably with a common covering 68, merely suggested in FIG. 15 and not to scale.

Figure 16:
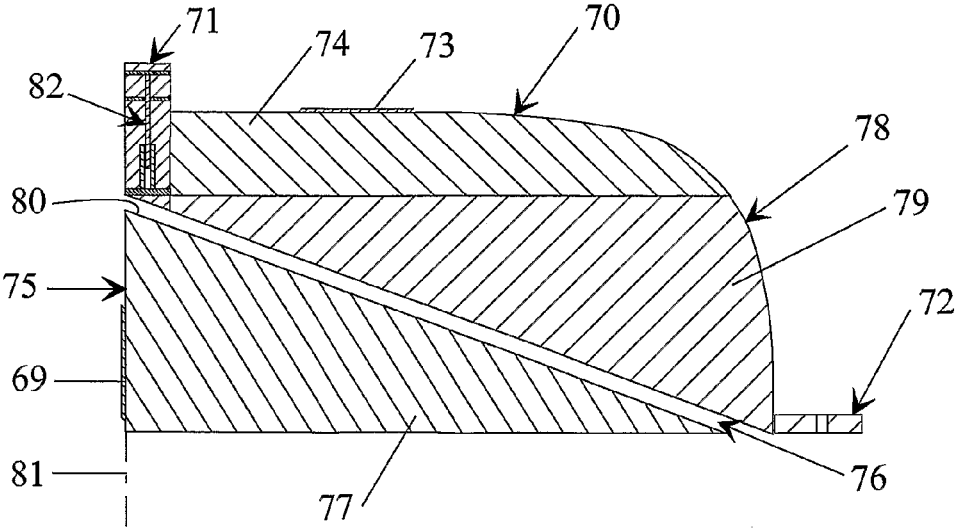
FIG. 16 shows a second exemplary embodiment of a beam with an edge strip set in place.

FIG. 16 shows a variant of a beam 70 with an edge strip 71 of reduced height attached to the outside of the bed and with a slat 72 on the inside of the bed, these parts again being enclosed jointly by covering 73, merely suggested in the drawing.

The beam 70 has a top layer 74, which becomes slightly deformable when heated, so that the beam 70 can hardly be sensed through the extension 37, 38 of the mattress 30.

Under the top layer 74, the beam 70 has a bottom layer 75, which again is provided with a diagonal separation 76. The separation 76 extends from the bottom edge of the layer 75 on the inside of the bed to the top edge on the outside of the bed. A lower wedge 77 resting on a carrier plate projects beyond the upper wedge 79 on the outside of the bed, the upper wedge again having a concave arc section 78. A shoulder 80 corresponding to the thickness of the edge strip 71 is thus created. As a result, the outside surface of the edge strip 71 and the outside surface of the lower wedge 77 lie in a common plane 81. As a result of the separation of the bottom layer 75 into the two wedges 77, 79, it is possible again to make use of different types of foamed plastic as desired or as needed. In particular, however, the idea is that a jacket around the bottom part of the mattress can be guided through the gap formed by the separation 76 (see FIG. 19).

Figure 17:
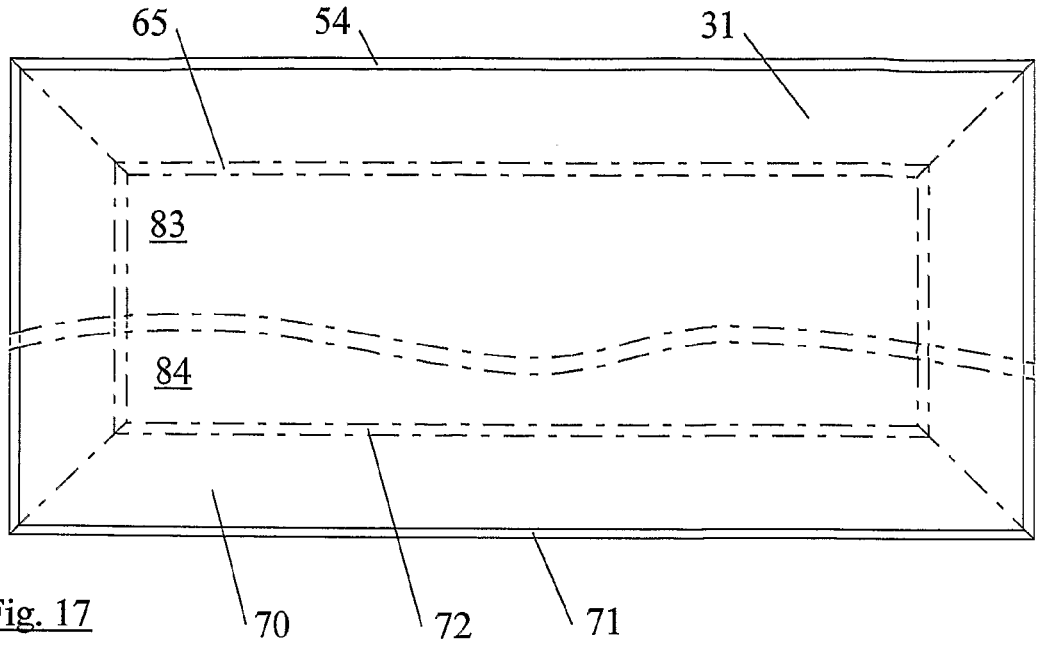
FIG. 17 shows a top view of a frame formed by beams with attached edge strips.

The top view of FIG. 17 shows a waterbed in which, in the upper part of the diagram, a beam 31, indicated in dash-dot line, is bounded on the outside of the waterbed by an edge strip 54. On the inside of the waterbed, the beam 31 is held in place by a slat 65. A water-filled mattress 83 is also enclosed and held in place on the outside by the edge strips 54.

The lower part of the diagram of FIG. 17 shows a mattress 84 and a beam 70, again indicated in dash-dot line, bounded on the outside of the bed by an edge strip 71. On the inside of the bed, the beam 70 is connected to a slat 72. The top and bottom parts of the diagram do not differ in the top view according to FIG. 17 even though the beam in the upper half is designed as shown in FIG. 15 and the beam in the lower half is designed as shown in FIG. 16.

Figure 18:
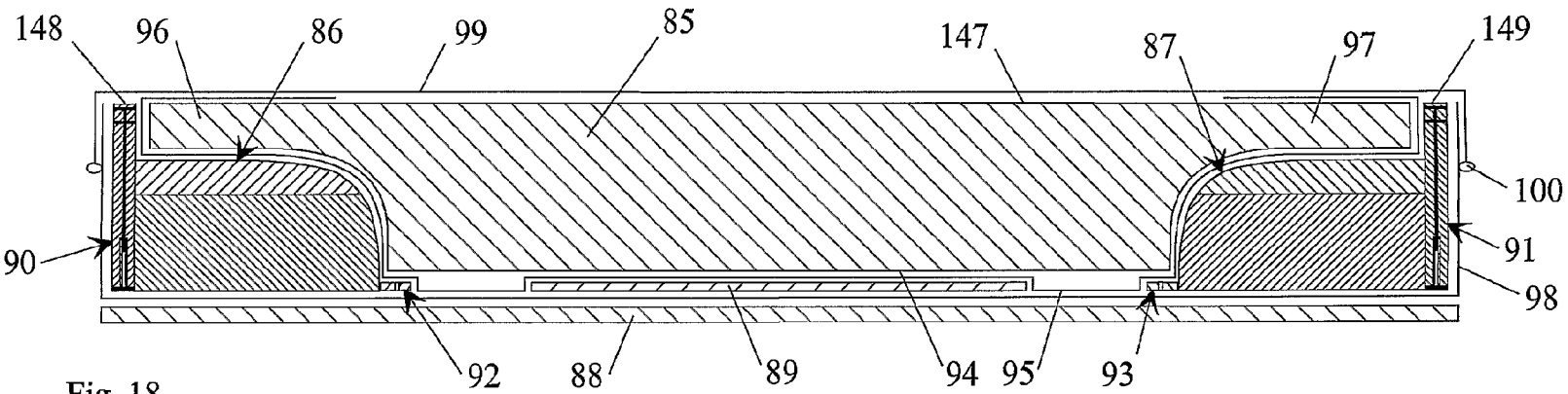
FIG. 18 shows a first cross section through a waterbed according to the invention.

FIG. 18 shows a cross section through a waterbed according to the invention. What is shown is a single mattress 85 according to FIG. 6. The mattress 85 is held in a frame formed by the beams 86, 87. The mattress 85 and also the beams 86, 87 rest on a common carrier plate 88. Because only one mattress 85 is provided, there is only one heater 89, located here centrally under the mattress 85, as merely suggested.

According to FIGS. 10-15 and the associated description, the beams 86, 87 are closed off by edge strips 90, 91 on the outside of the bed. On the inside of the bed, the slats 92, 93 are installed next to the beams 86, 87. The beams 86, 87, with the associated edge strips 90, 91 and the slats 92, 93 are each provided with a common covering, not shown in FIG. 18.

Between this covering and the carrier plate 88 on the one hand and the bottom surface 94 of the mattress 85 on the other, a safety tub 95 is provided, which reliably contains any liquid which may escapes in the event of a leak. At the outside edge, the safety tub 95, which can be a sheet of PVC, for example, is drawn inward across the extensions 96, 97 of rectangular cross section of the mattress 85.

A jacket 98, resting directly on the carrier plate 88 and drawn upward along the edge strips 90, 91 on the outside of the bed as far as the top end of the strips, is also provided for the bottom half of the mattress. The upper part of the mattress is also covered by a jacket 99. In the present exemplary embodiment, the two jackets 98, 99 are connected to each other by a zipper 100.

The jacket 98 for the bottom part of the mattress and the beams 86, 87 define a tub with a rectangular outline, which is dimensionally stable. The heater 89 is installed in this tub. In the conventional manner, the heater is thermostat-controlled to keep the temperature of the liquid in the mattress 85 constant. After the safety tub 95 has been installed, the mattress 85 can easily put in position.

Figure 19:
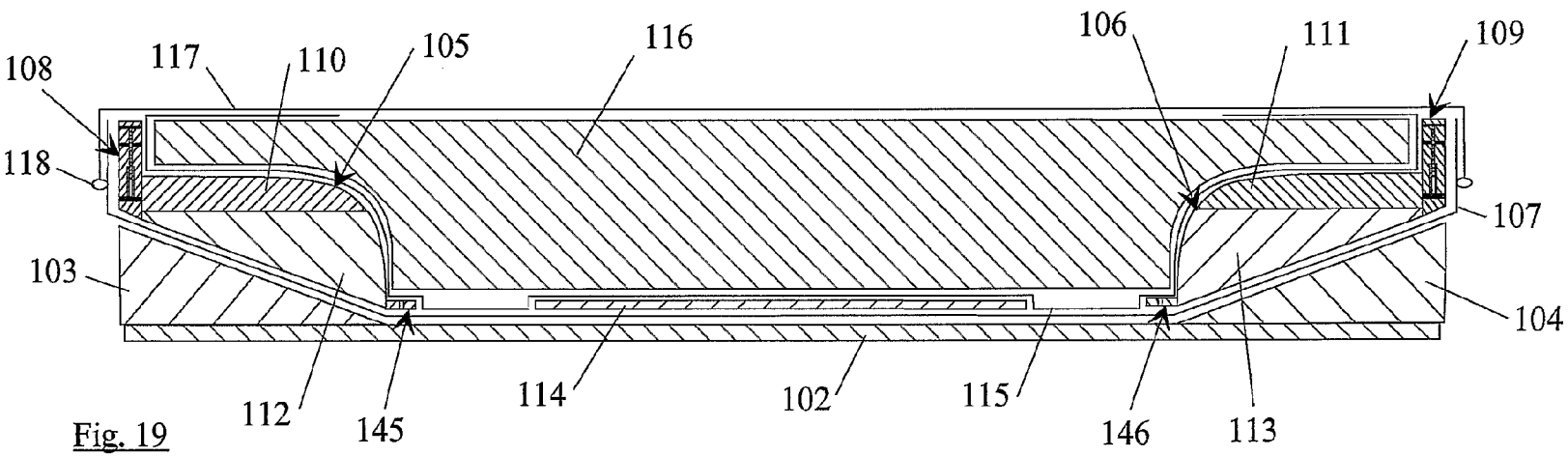
FIG. 19 shows a variant of the waterbed according to FIG. 18.

FIG. 19 shows a variant. The lower wedges 103, 104 of beams 105, 106 are permanently and directly connected, preferably bonded with an adhesive, to a carrier plate 102, possibly consisting of several parts, so that they extend around the outside edges of the plate. Each of these lower wedges 103, 104 can be provided with its own jacket (not shown).

As a result of the attachment of the wedges 103, 104 to the carrier plate 102, a tub-like frame structure is already created, which precisely positions the rest of the waterbed.

A jacket 107 covers the carrier plate 102 and also the slanted surfaces of the wedges 103, 104 and is drawn vertically upward on the outside to cover the outside surfaces of the edge strips 108, 109 adjoining the outside edges of the top layers 110, 111. The edge strips 108, 109; the top layers 110, 111, which are attached to the wedges 112, 113 situated underneath; and the wedges, which are connected in turn to the slats 114, 115, are each enclosed by a common jacket and, when placed onto the jacket 107, are immediately positioned correctly as a unit by the slanted surface of the lower wedges 103, 104. Thereupon the heater 114 can be installed. A safety tub 115 like that of the preceding exemplary embodiment then also extends around the outside surfaces of the mattress 116, the mattress being covered in turn by another jacket 117, which is connected to jacket 107 by a zipper 118.

FIG. 18 clearly shows that the edge strips 90, 91 project vertically beyond the beams 86, 87 and that their top ends 148, 149 are more-or-less flush with the bed surface 147 of the mattress 85—see also FIG. 19.

Figure 21:
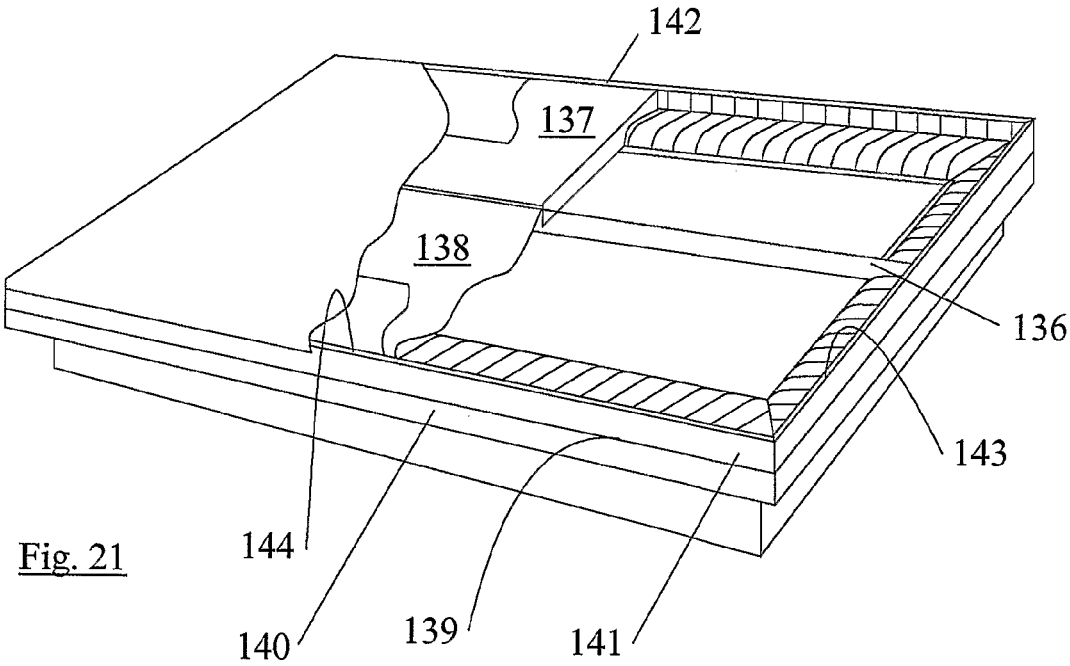
FIG. 21 shows another variant of this.
Figure 20:
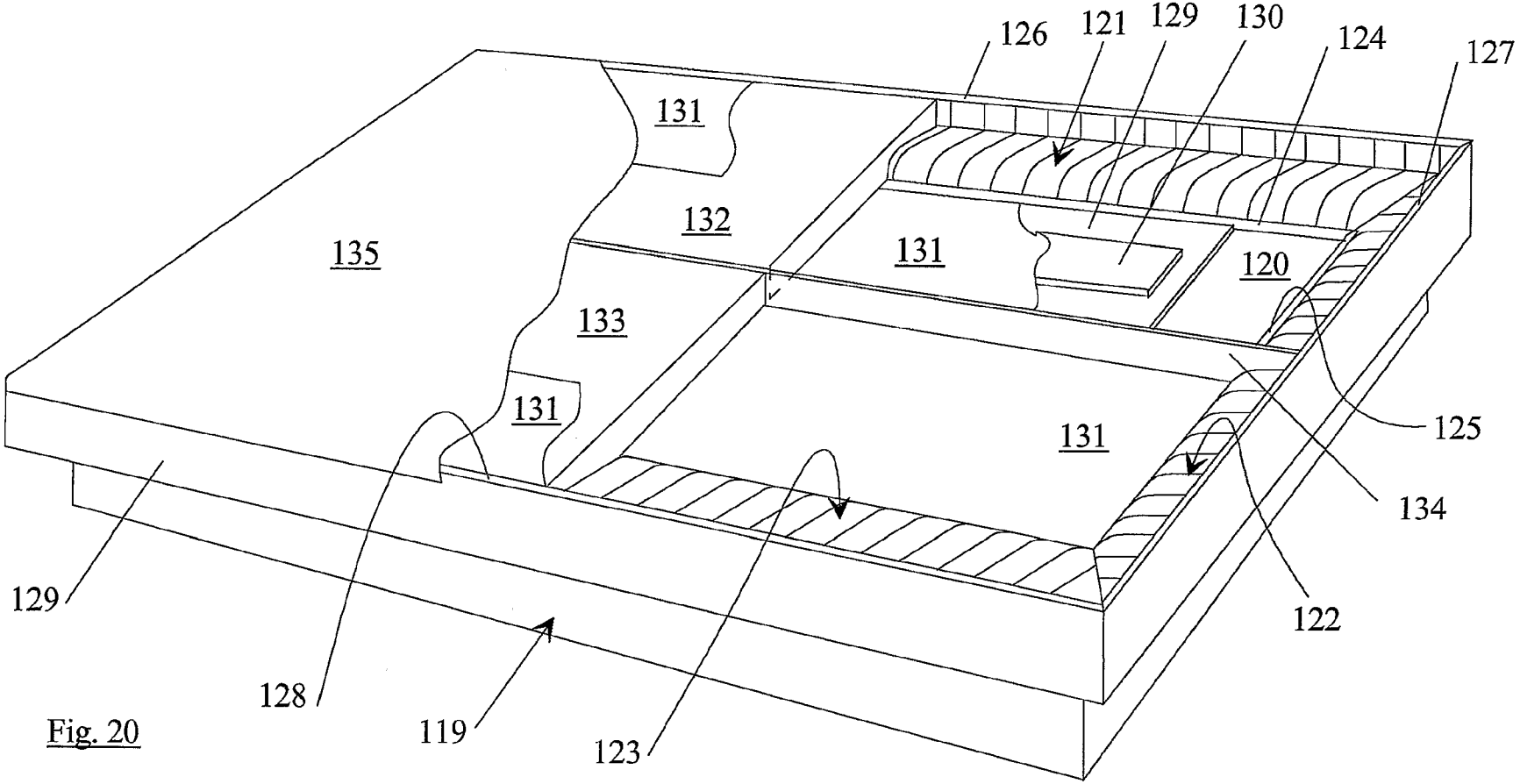
FIG. 20 shows a partially exploded isometric diagram of a waterbed according to the invention.

FIGS. 20 and 21 show embodiments corresponding to FIGS. 18 and 19, except that here two mattresses are provided, which are insulated from each other by a thermally insulating partition wall.

FIG. 20 shows a carrier plate 120, possibly consisting of several parts, resting on a stable, load-bearing substructure 119. The carrier plate projects horizontally beyond the substructure 119. On the outside edge of the carrier plate 120, beams 121-123 are provided all the way around, which, on the inside of the bed, rest against slats 124, 125. On the outside of the waterbed, the beams 121-123 are closed off by edge strips 126-128.

A heater 130 rests on a jacket 129 covering the carrier plate 120. The jacket 129 is pulled through under the beams 121-123 and the edge strips 126-128 and then drawn upward on the outside, forming a facing for the outside surfaces of the edge strips 126-128.

The jacket 129, heater 130, and the beams 121-123 are covered by a safety tub 131, which holds the two mattresses 132, 133 as in the exemplary embodiment according to FIG. 20 and covers their edges. The mattresses 132, 133 are separated from each other by a thermally insulating partition wall 134, which divides the beam 122 or is provided with a corresponding recess and simply rests on the beam in positive fashion.

On top, the waterbed according to the invention is covered by an additional jacket 135, which is preferably connected to the jacket 129 by a zipper (not shown in FIG. 20).

In the exemplary embodiment of a waterbed according to FIG. 21, beams according to FIG. 16 are used, which hold two mattresses 137, 138, which are separated from each other by a thermal partition wall 136. That these types of beams are being used here is also revealed externally by the presence of the separation seam 139, which separates the one covering 140 of the lower wedges of the beams from the bottom jacket 141, which is drawn up along the outside surfaces of the edge strips 142-144 (see FIG. 19).

The invention claimed is:

1. A waterbed comprising:

a frame formed by a plurality of beams; and at least one water-filled mattress being supported on the frame, the at least one mattress forming a bed surface which is substantially flat in an unloaded state;

wherein at least one beam of the plurality of beams has a convexly curved portion on an inside of the waterbed facing the mattress, the convexly curved portion rising in an arc portion and merging with a flat top surface, and wherein the at least one mattress is formed with a concave recess conforming with the convexly curved portion and comprises an extension covering the flat top surface on the beam such that a water-filled height of the at least one mattress in the unloaded state lies above the flat top surface of the beam and extends to a top outside edge of the beam.

2. The waterbed of claim 1, wherein the extension of the mattress is flush with an outside surface of the beam.

3. The waterbed of claim 1, wherein the at least one beam comprises a deformable top portion and a mechanically stable bottom portion.

4. The waterbed of claim 3, wherein the bottom portion is diagonally divided forming a lower wedge facing towards the inside of the waterbed and an upper wedge forming at least part of the convexly curved portion on the inside of the waterbed.

5. The waterbed of claim 4, wherein, on an outside of the waterbed, the lower wedge projects beyond both the upper wedge of the bottom portion and the top portion by a distance equal to the thickness of an edge strip, thereby forming a shoulder for supporting an edge strip thereon.

6. The waterbed of claim 5, wherein the edge strip is formed of a foamed plastic material.

7. The waterbed of claim 4, further comprising:

an edge strip attached to at least a portion of an outside of the at least one beam;

a common covering provided for the top portion and the upper wedge of the bottom portion and the edge strip; and a slat portion connected to the beam on the inside of the waterbed for attaching the at least one beam to a common carrier plate.

8. The waterbed of claim 3, wherein, on an outside of the waterbed, the bottom portion of the at least one beam projects outwardly beyond the upper portion by a distance equal to the thickness of an edge strip, thereby forming a shoulder for supporting an edge strip thereon.

9. The waterbed of claim 3, wherein the deformable top portion comprises a foamed plastic material which becomes flexible when being heated.

10. The waterbed of claim 1, further comprising an edge strip bound to an outside of the at least one beam and projecting beyond a top surface of the beam to the bed surface of the mattress.

11. The waterbed of claim 10, wherein the at least one beam and the edge strip are flush with each other along a common bottom plane.

12. The waterbed of claim 1, further comprising at least one edge strip attached to at least a portion of an outside of the at least one beam.

13. The waterbed of claim 12, wherein the edge strip comprises a stabilizing member which comprises a horizontal first flat profile at one end of the stabilization member, a round bar on which the first flat profile rests, and a guide sleeve in which one end of the round bar is held to freely vertically move therein.

14. The waterbed of claim 13, wherein the stabilizing member further comprises a second flat profile, which is formed with openings through which the round bar passes, wherein the second flat profile is provided in the upper section of the edge strip underneath the first flat profile.

15. The waterbed of claim 14, wherein the edge strip is closed off on its bottom by a third flat profile.

16. The waterbed of claim 15, wherein the third flat profile is a metal strip.

17. The waterbed of claim 14, wherein the first and second flat profiles are metal strips.

18. The waterbed of claim 1, wherein the beams are formed of a foamed plastic material.

19. The waterbed of claim 1, wherein the extension of the mattress has a rectangular cross section.

20. The waterbed of claim 1, further comprising a plurality of edge strips attached to an outside surface of the beam, each of the edge strips having a stabilizing member which comprises a horizontal first flat profile at one end of the stabilization member, a round bar on which the first flat profile rests, and a guide sleeve in which one end of the round bar is held to freely vertically move therein, wherein the round bars are spaced apart from one another.

21. A waterbed comprising:

a frame formed by a plurality of beams; and at least one water-filled mattress being supported on the frame, the at least one mattress forming a bed surface which is substantially flat in an unloaded state;

wherein at least one beam of the plurality of beams has a convexly curved portion on an inside of the waterbed, the convexly curved portion rising in an arc portion and merging with a flat top surface, the at least one beam comprising a deformable top portion and a mechanically stable bottom portion, wherein the at least one mattress is formed with a concave recess conforming with the convexly curved portion and comprises an extension covering the flat top surface on the beam; and at least one edge strip attached to at least a portion of an outside of the at least one beam, wherein, on an outside of the waterbed, the bottom portion of the at least one beam projects outwardly beyond the upper portion by a distance equal to the thickness of the edge strip, thereby forming a shoulder for supporting the edge strip thereon.

22. A waterbed comprising:

a frame formed by a plurality of beams; and at least one water-filled mattress being supported on the frame, the at least one mattress forming a bed surface which is substantially flat in an unloaded state;

wherein at least one beam of the plurality of beams has a convexly curved portion on an inside of the waterbed, the convexly curved portion rising in an arc portion and merging with a flat top surface, the at least one beam comprising a deformable top portion and a mechanically stable bottom portion, the bottom portion being diagonally divided forming a lower wedge facing towards the inside of the waterbed and an upper wedge forming at least part of the convexly curved portion on the inside of the waterbed, wherein the at least one mattress is formed with a concave recess conforming with the convexly curved portion and comprises an extension covering the flat top surface on the beam;

an edge strip attached to at least a portion of an outside of the at least one beam;

a common covering provided for the top portion and the upper wedge of the bottom portion and the edge strip; and a slat portion connected to the beam on the inside of the waterbed for attaching the at least one beam to a common carrier plate.

* * * * *